United States Patent [19]

Takahashi

[11] Patent Number: 4,822,024

[45] Date of Patent: Apr. 18, 1989

[54] SORTER FOR UPWARDLY CURVING COPY SHEETS

[75] Inventor: Koji Takahashi, Kanagawa, Japan

[73] Assignee: Fuji Xerox Co., Ltd., Tokyo, Japan

[21] Appl. No.: 497,973

[22] Filed: May 25, 1983

[30] Foreign Application Priority Data

May 31, 1982 [JP] Japan ..... 57-92412

[51] Int. Cl.[4] ..... B65H 39/10

[52] U.S. Cl. ..... 271/296; 271/209; 271/306

[58] Field of Search ..... 271/296, 208, 209, 180, 271/278, 306, 287–290; 162/270, 271

[56] References Cited

U.S. PATENT DOCUMENTS

| | | | |
|---|---|---|---|
| 3,372,922 | 3/1968 | Snellman et al. | 271/296 |
| 4,200,278 | 4/1980 | Gindri | 271/296 |
| 4,216,955 | 8/1980 | Avritt et al. | 271/296 |

FOREIGN PATENT DOCUMENTS

| | | | |
|---|---|---|---|
| 0155151 | 12/1981 | Japan | 271/287 |

*Primary Examiner*—Joseph J. Rolla

*Attorney, Agent, or Firm*—Sughrue, Mion, Zinn, Macpeak & Seas

[57] ABSTRACT

A sorter for sorting copy sheets which are produced by a copying machine from an original document includes a plurality of trays which are vertically arranged in multiple stages at predetermined intervals and an indexer for selecting a tray from the plurality of trays to which an individual copy sheet is to be conveyed. The indexer includes a first roller which changes a direction of conveyance of the copy sheets, and the first roller curves the copy sheets upward so that ends of the upwardly curved copy sheets curve downwardly with respect to a bottom surface of the trays, thereby increasing the number of copy sheets which can be stacked in the trays and preventing the occurrence of paper jams.

8 Claims, 3 Drawing Sheets

PRIOR ART FIG. 1(A)
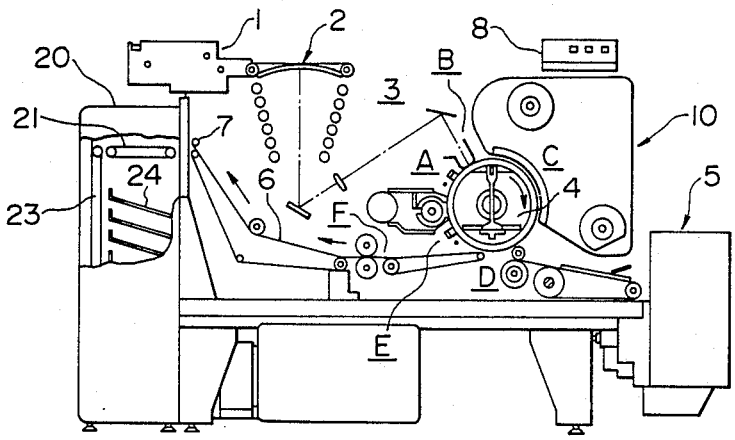
PRIOR ART FIG. 1(B)
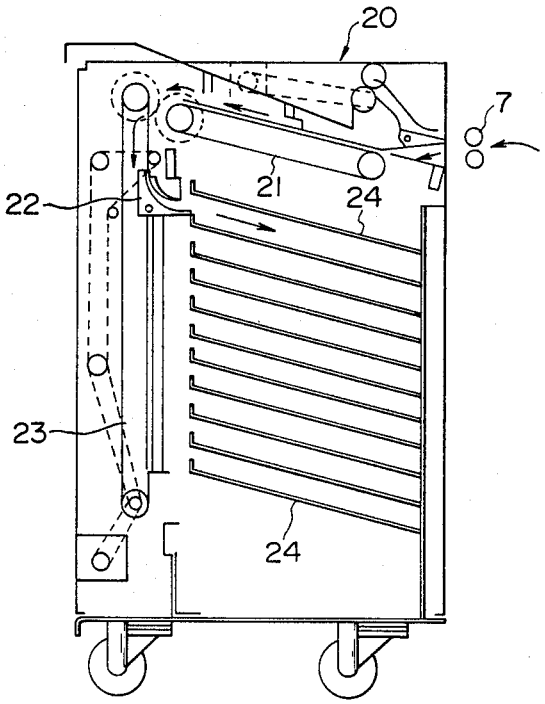

PRIOR ART FIG. 1(C)
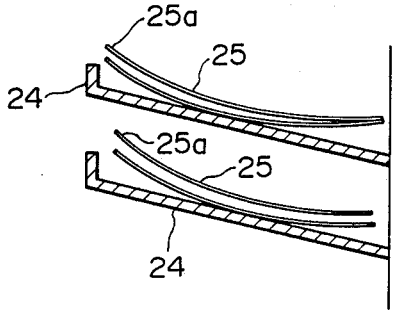
FIG. 2(A)
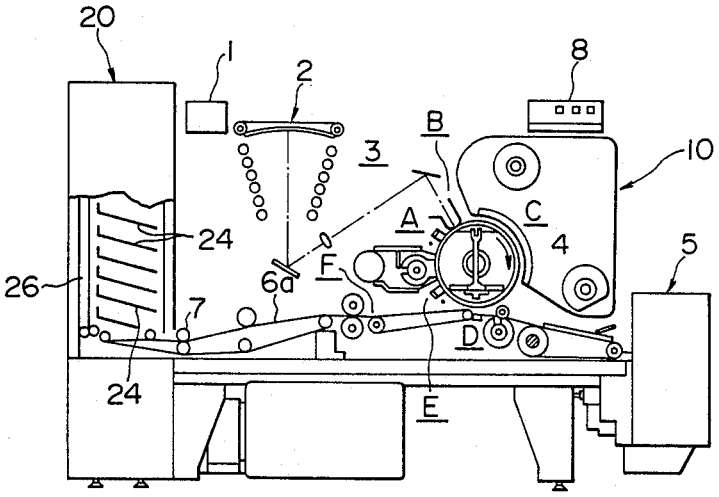

SORTER FOR UPWARDLY CURVING COPY SHEETS

BACKGROUND OF THE INVENTION

1. Field of the Invention

The present invention relates to a method of sorting copy sheets and a sorter (automatic page arrangement device) which is capable of automatically classifying and arranging copied sheets when a plurality of sheets are copied from an original document, and, particularly, to a sorter for use in a copying machine which is intended to prevent paper jams from occurring in an indexer portion of the sorter.

2. Description of the Prior Art

FIGS. 1A and 1B illustrate a conventional sorter which is used in a copying machine for automatically classifying and arranging a plurality of copy sheets. The copying machine-sorter arrangement of FIGS. 1A and 1B comprises a document feeding device 1 for automatically feeding an original document; a platen 2 for receiving the original document which is fed from the document feeding device in a predetermined position; an optical system 3 for projecting a picture image of the document which has been placed on the paten 2 onto an exposing station B; a photo-sensitive drum 4 which is capable of turning along its circumference past a charging station A, the above-mentioned exposing station B, a developing station C, a transferring station D and a cleaning station E (including an electrical discharger); a copy paper feeder 5; a fixing station F for fixing the picture image which has been transferred onto a sheet of copy paper; a discharge belt 6 for discharging a copied sheet into a sorter 20 with the help of discharge rollers 7; an actuating panel 8 for issuing commands for various operations; and the sorter 20 which is provided at the side of a copying machine 10. The sorter 20 comprises a first endless belt 21 for conveying a copy sheet which has been discharged through the discharge rollers 7; a second endless belt 23 for conveying a copy sheet to an indexer 22 in cooperation with the first endless belt 21; and the above-mentioned indexer 22 for classifying and delivering copy sheets to the respective multi-stage trays 24.

The operation of the conventional copying machine-sorter arrangement will now be described. Each of the copy sheets which has been successively discharged from the copying machine 10 is deflected by the second endless belt 23 and guided by the indexer 22 so that it is introduced into the respective trays 24, one after another, successively, from the upper tray to the lower trays.

However, in this sorter 20, each of the sorted copy sheets 25, which is deflected by the second endless belt 23, guided by the indexer 22 and then received in the tray 24, is curved downward, as shown in FIG. 1C, because the sheet is supplied with uneven stress in the direction of its thickness when it is deflected. If the respective copy sheets received in the trays 24 are curved downward, the front end of a further copy sheet which next enters any one of the trays 24 will hit upon the end 25*a* of a previously sorted copy sheet 25 since the end 25*a* projects upward beyond the height of the tray 24. Accordingly, paper jams occur in the indexer 22. Even if no paper jams occur, because the end 25*a* projects upward, it is apparent that the copy sheet capacity of the trays 24 is reduced.

SUMMARY OF THE INVENTION

An object of the present invention is to provide a sorter in which a curve-producing mechanism is provided in an indexer for making flat or upwardly curved copy sheets curve downward as they are introduced into a tray, thereby increasing the number of sheets which can be received in the tray, as well as preventing the occurrence of paper jams.

The sorter of the present invention includes a plurality of trays which are vertically arranged in multiple stages at predetermined intervals, and means for conveying copy sheets into said plurality of trays and upwardly curving said copy sheets so that ends of said upwardly curved copy sheets curve downward with respect to a bottom surface of the trays. The conveying and curving means includes a conveyor which comprises an endless belt and a film sheet which convey the copy sheets to an indexer. The indexer then curves the sheets and conveys the curved sheets into the plurality of trays.

The method of the invention includes the steps of discharging copy sheets from a bottom portion of a copying machine; introducing the discharged copy sheets into a bottom portion of a sorter; conveying the introduced copy sheets upward through the sorter into one of a plurality of discharge trays; and upwardly curving the copy sheets so that their ends curve downward with respect to a bottom surface of the trays. The angle of curvature of the copy sheets is varied by varying a diameter of a first roller which is used to change a direction of conveyance of the copy sheets and also by varying a diameter ratio of a pair of opposed rollers between which the copy sheets pass after being transported past the first roller.

BRIEF DESCRIPTION OF THE DRAWINGS

FIG. 1A is an explanatory view showing a conventional copying machine and a sorter therefor;

FIG. 1B is an enlarged, partial view of the sorter of FIG. 1A;

FIG. 1C is a schematic view showing the state of copy sheets as they are received in a tray of the sorter;

FIG. 2A is an explanatory view showing an embodiment of the present invention.

DESCRIPTION OF THE PREFERRED EMBODIMENTS

Figure 2B:
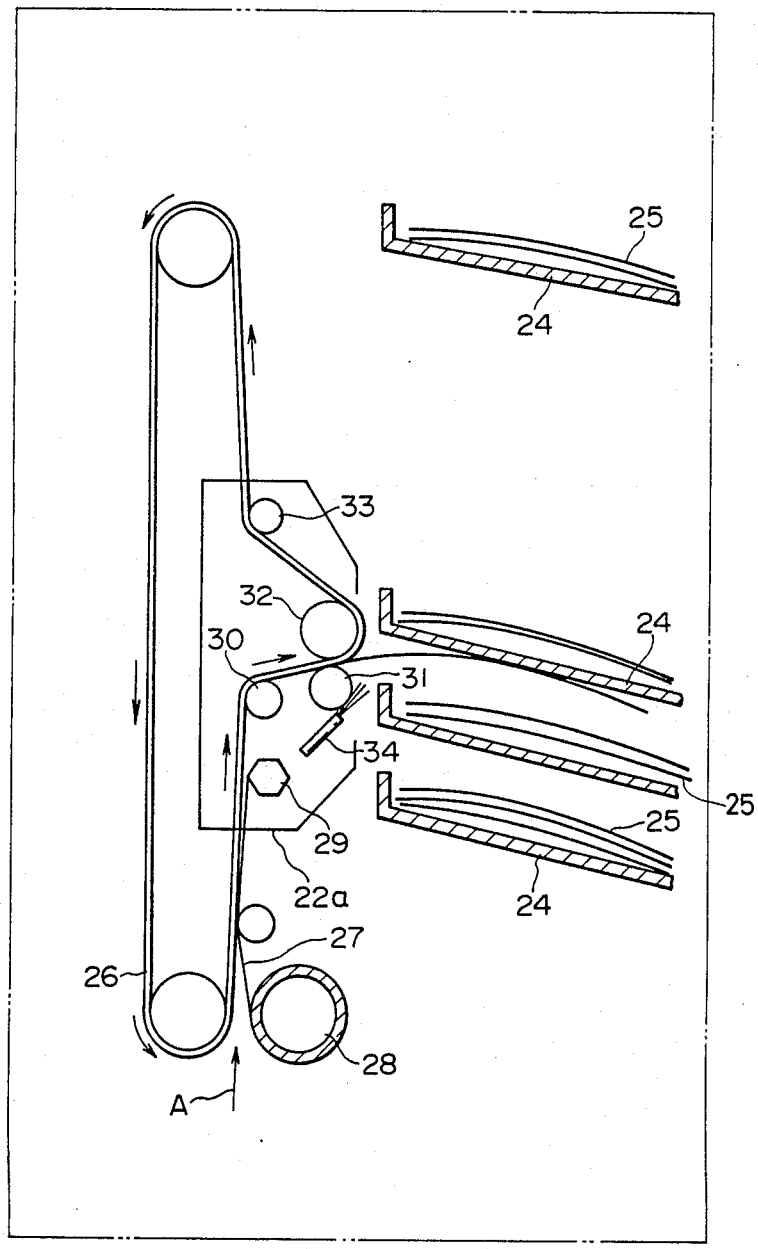
FIG. 2B is an enlarged partial view of the sorter of FIG. 2A.

FIG. 2A illustrates a copying machine-sorter arrangement of the present invention, and FIG. 2B is an enlarged, partial view of the sorter shown in FIG. 2A. Components illustrated in FIGS. 2A and 2B which are identical to components illustrated in FIGS. 1A and 1B are identified by the same reference numerals, and, therefore, an explanation of the identical components will not be repeated. In the arrangement of FIGS. 2A and 2B, a copy sheet which has passed the fixing station E is discharged through the discharge rollers 7 by a discharge belt 6*a* which is provided at the lower portion of the copying machine 10, and the copy sheet is then introduced into a lower portion of the sorter 20.

The sorter 20, according to the present invention, comprises multi-stage trays 24 which are vertically arranged at predetermined intervals; an endless belt 26 which is vertically disposed among the multi-stage trays 24; a film sheet 27 for conveying a copy sheet 25 to the trays 24 in cooperation with the endless belt 26; a film sheet fixing device 29 for fixing an end of the film sheet 27; an indexer 22a which is provided with rollers 30, 31, 32 and 33 for successively delivering copy sheets to the trays from a lower tray to an upper tray; a discharging brush 34 for eliminating static electricity from each copy sheet 25; and a roller 28 for winding up/off the film sheet 27.

The operation of the sorter of the present invention will now be described. A copy sheet 25 which is introduced into the sorter 20 through the lower portion of the sorter is inserted between the endless belt 26 and the film sheet 27 from the direction indicated by an arrow A. It is then conveyed upward with the upward movement of the endless belt 26 so that it is received into one of the trays 24. The copy sheet 25 is then curved upward by the endless bet 26 and the roller 30, as shown in FIG. 2B.

The upward curve of the copy sheet 25 may be formed by the rollers 31 and 32; however, the upward curve is formed mainly by the endless belt 26 and the roller 30 in the embodiment shown in FIG. 2B. When it is desired to form the upward curve principally by using the rollers 31 and 32, the diameter of the roller 31 should be made smaller than that of the roller 32 because the amount of upward curve of the copy sheet increases as the ratio between these diameters increases. The amount of upward curve of the copy sheets also increases as the diameter of the roller 30 is reduced, assuming, of course, that other variables are maintained constant. Thus, according to the embodiment of the present invention, the extent of the upward curve of the copy sheets may be controlled as desired by properly selecting the diameter of the roller 30 and the diameter ratio between the rollers 32 and 31.

In this embodiment, copy sheets are successively delivered, one-by-one, to the trays 24 from the lower tray to the upper trays. To this end, the indexer 22a is vertically moved by a suitable driving means (not shown) past the inlet portions of the trays 24.

As described above, in the sorter according to the present invention, an indexer is provided with a curve-producing mechanism for making a copy sheet flat or upwardly curved when it is received in one of the trays, thereby increasing the number of copy sheets which can be received in the trays, as well as preventing the occurrence of paper jams.

I claim:

1. A sorter for sorting copy sheets made from an original by a copying machine, comprising:

a plurality of trays vertically arranged in multiple stages at predetermined intervals; and means for conveying copy sheets into said plurality of trays and upwardly curving said sheets so that ends of said upwardly curved copy sheets curve downwardly with respect to a bottom surface of said trays, said means for conveying comprising a first roller and a web for conveying said paper past said first roller, said web passing over said first roller to change direction while conveying said paper between said web and said first roller, an angle of curvature of said copy sheets being a function of the a diameter of said first roller.

2. The sorter as claimed in claim 1, wherein said curved sheet ends correspond to front and rear ends of said copy sheets relative to a conveying direction thereof.

3. The sorter as claimed in claim 1, wherein said conveying and curving means comprises:

an indexer for selecting which of said plurality of trays any one of said copy sheets is to be conveyed; and a conveyor for conveying said copy sheets to said indexer.

4. The sorter as claimed in claim 3, wherein said upward curve producing mechanism further comprises two additional opposed rollers having different diameters which are located downstream of said first roller, said conveyed copy sheets being transported between said two additional opposed rollers.

5. The sorter as claimed in claim 4, wherein said conveyor comprises an endless belt and a film sheet, said copy sheets being conveyed between said endless belt and said film sheet to said indexer.

6. The sorter as claimed in claim 3, wherein said trays receive said copy sheets at an inlet end and are downwardly inclined away from said inlet end.

7. A method of sorting copy sheets of an original produced by a copying machine, comprising the steps of:

discharging copy sheets of an original from a bottom portion of a copying machine;

introducing said discharged copy sheets into a bottom portion of a sorter;

conveying said introduced copy sheets upward through said sorter into any one of a plurality of discharge trays vertically arranged in multiple stages at predetermined intervals said conveying step comprising conveying said copy sheets between a web and a first roller, changing a running direction of said web and copy sheets for upwardly curving said copy sheets so that said ends thereof curve downwardly with respect to a bottom surface of said trays; wherein said conveying step further comprises passing said copy sheets between a pair of opposed rollers downstream of said first roller, and controlling an angle of curvature of said copy sheets by selecting a diameter ratio of said pair of opposed rollers.

8. The method as claimed in claim 7, further comprising the step of providing a desired angle of curvature of said copy sheets by providing said first roller with a diameter related to said desired angle of curvature in order to change a direction of conveyance of said copy sheets so that said copy sheets can be conveyed into said discharge trays with said desired angle of curvature.

* * * * *